US011679842B2

(12) United States Patent
Elliott

(10) Patent No.: US 11,679,842 B2
(45) Date of Patent: Jun. 20, 2023

(54) FAIRLEAD WITH ILLUMINATION MODULE

(71) Applicant: Forcome Co. Ltd, Shanghai (CN)

(72) Inventor: Ronald L. Elliott, Oregon City, OR (US)

(73) Assignee: Forcome Co. Ltd., Shanghai (CN)

( * ) Notice: Subject to any disclaimer, the term of this patent is extended or adjusted under 35 U.S.C. 154(b) by 320 days.

(21) Appl. No.: 17/102,216

(22) Filed: Nov. 23, 2020

(65) Prior Publication Data

US 2021/0155321 A1 May 27, 2021

Related U.S. Application Data

(60) Provisional application No. 62/938,857, filed on Nov. 21, 2019.

(51) Int. Cl.

| | |
|---|---|
| ***B63B 21/10*** | (2006.01) |
| ***B66D 1/36*** | (2006.01) |
| ***F21V 33/00*** | (2006.01) |
| ***B66D 1/48*** | (2006.01) |
| *F21Y 115/10* | (2016.01) |

(52) U.S. Cl.

CPC ..... *B63B 21/10* (2013.01); *B66D 1/36* (2013.01); *B66D 1/485* (2013.01); *F21V 33/00* (2013.01); *B66D 2700/0191* (2013.01); *F21Y 2115/10* (2016.08)

(58) Field of Classification Search

CPC .. B63B 21/10; B66D 1/00; B66D 1/28; B66D 1/36; B66D 1/485; B66D 2700/0191; F21V 33/00; F21Y 2115/10; B60Q 1/2661

USPC ..... 254/390

See application file for complete search history.

(56) References Cited

U.S. PATENT DOCUMENTS

| | | | | |
|---|---|---|---|---|
| 9,682,649 | B2 * | 6/2017 | Salter et al. | B66D 1/28 362/600 |
| 10,392,235 | B2 * | 8/2019 | Fretz et al. | B66D 1/28 |
| 2017/0321851 | A1 * | 11/2017 | Fretz et al. | B63B 21/10 362/234 |
| 2018/0118530 | A1 * | 5/2018 | August et al. | B66D 1/18 |
| 2019/0263641 | A1 * | 8/2019 | Hall et al. | B66D 1/54 |

FOREIGN PATENT DOCUMENTS

| | | | | |
|---|---|---|---|---|
| CN | 206644951 U | * | 11/2017 | B63B 21/10 |

* cited by examiner

*Primary Examiner* — Michael R Mansen
*Assistant Examiner* — Henrix Soto
(74) *Attorney, Agent, or Firm* — McCoy Russell LLP

(57) ABSTRACT

Methods and systems are provided for a fairlead with an illumination module. In one example, a fairlead includes an illumination module seated against a recessed mounting surface. The illumination module is housed within a body of the fairlead and configured to illuminate a main opening of the fairlead.

20 Claims, 10 Drawing Sheets

FAIRLEAD WITH ILLUMINATION MODULE

CROSS-REFERENCE TO RELATED APPLICATION

This application claims benefit of U.S. Provisional Patent Application No. 62/938,857, filed Nov. 21, 2019, and entitled "FAIRLEAD WITH ILLUMINATION MODULE". The entire contents of the above-referenced application are incorporated herein by reference.

FIELD

The present description relates generally to methods and systems for fairleads, and in particular, to fairleads for winches.

BACKGROUND/SUMMARY

Fairleads, such as fairleads for winches, are often used to guide ropes extending from a drum or spool. A fairlead may include an opening configured to receive a rope, with the opening including surfaces shaped to reduce rubbing that may cause degradation of the rope. The opening of the fairlead is often narrow in order to control an angle of the rope as the rope unwinds from the drum or spool and passes through the opening.

The inventors herein have recognized potential issues with such systems. As one example, winches are often mounted at a front of a vehicle in such a way that visibility of a spool or drum of the winch is reduced. Although a fairlead may be used to guide a rope of the winch, the positioning of the fairlead may further reduce the visibility of the spool or drum and may reduce an amount of other components that may be coupled to the winch. Such configurations may result in poor visibility of the rope as the rope extends into the opening of the fairlead. Further, during low light conditions, management of the position of the rope with respect to the spool or drum may be difficult.

In one example, the issues described above may be addressed by a fairlead, comprising: a body including a front end, a rear end, and a main opening extending between the front end and the rear end, where the main opening is shaped to guide a rope from the front end to the rear end; a first recess formed in the body at the rear end; and a first illumination module seated within the first recess and configured to illuminate the main opening from the rear end.

It should be understood that the summary above is provided to introduce in simplified form a selection of concepts that are further described in the detailed description. It is not meant to identify key or essential features of the disclosed subject matter. Furthermore, the disclosed subject matter is not limited to implementations that solve any disadvantages noted above or in any part of this disclosure.

BRIEF DESCRIPTION OF THE DRAWINGS

FIGS. 2-4, 6-8, and 10-11 are shown to scale, though other relative dimensions may be used, if desired.

DETAILED DESCRIPTION

Figure 3:
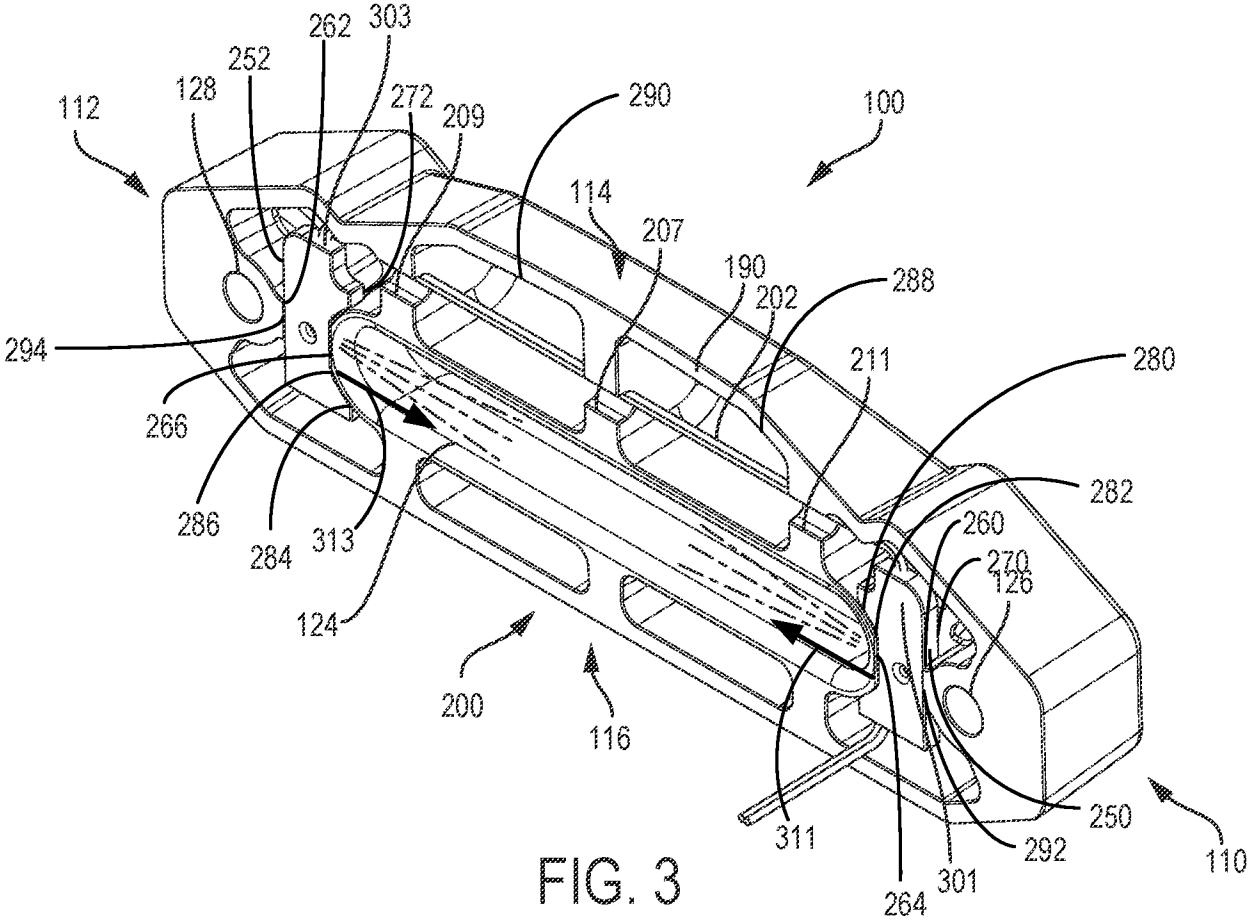
FIG. 3 shows a rear perspective view of the fairlead of FIGS. 1-2 with the illumination module coupled to the fairlead.
Figure 4:
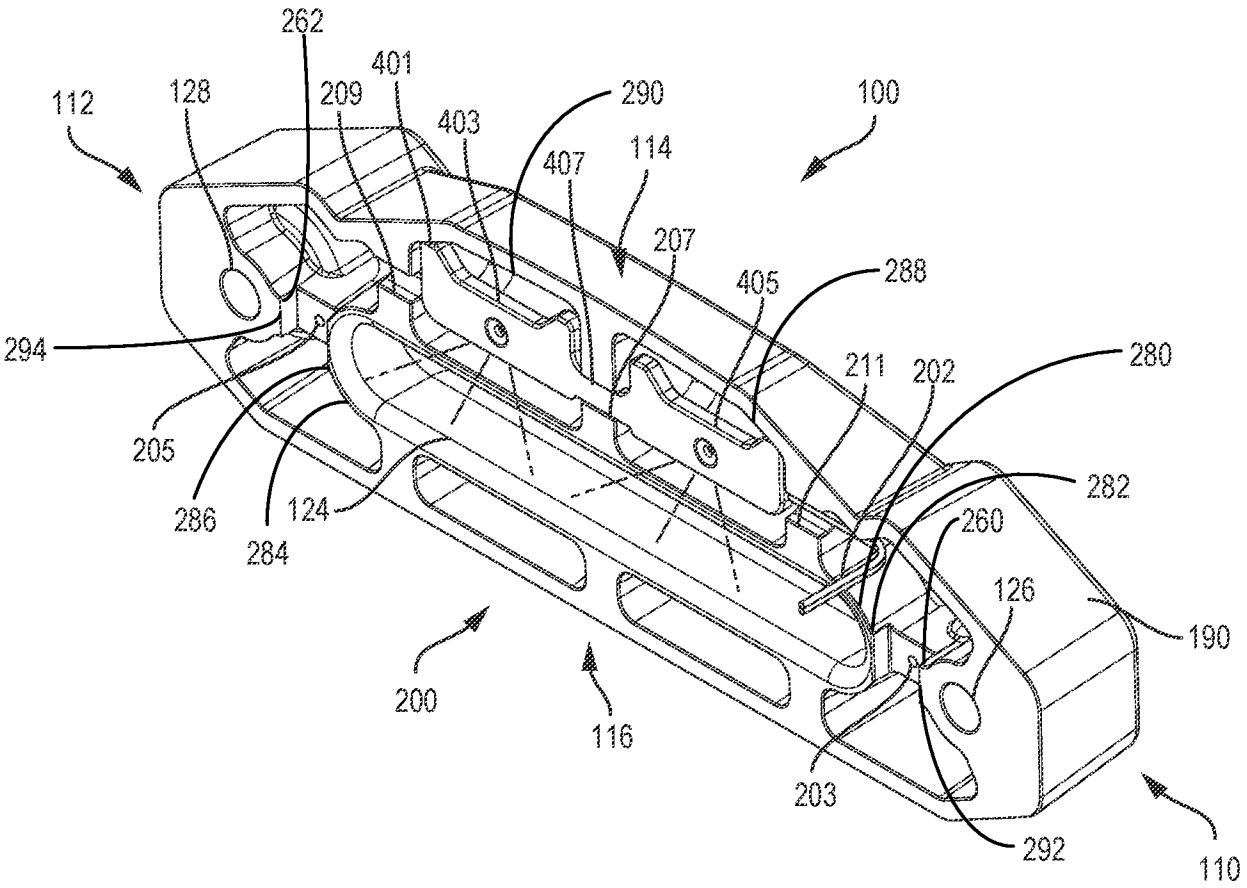
FIG. 4 shows a rear perspective view of the fairlead of FIGS. 1-3 with another illumination module coupled to the fairlead.
Figure 6:
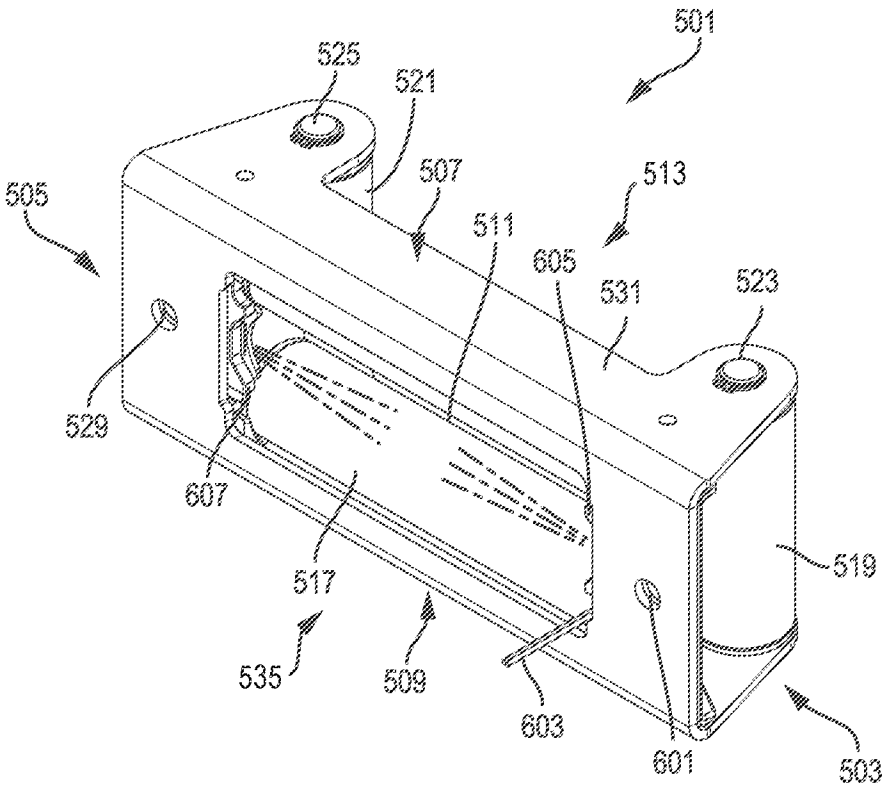
FIG. 6 shows a rear perspective view of the roller fairlead of FIG. 5.
Figure 7:
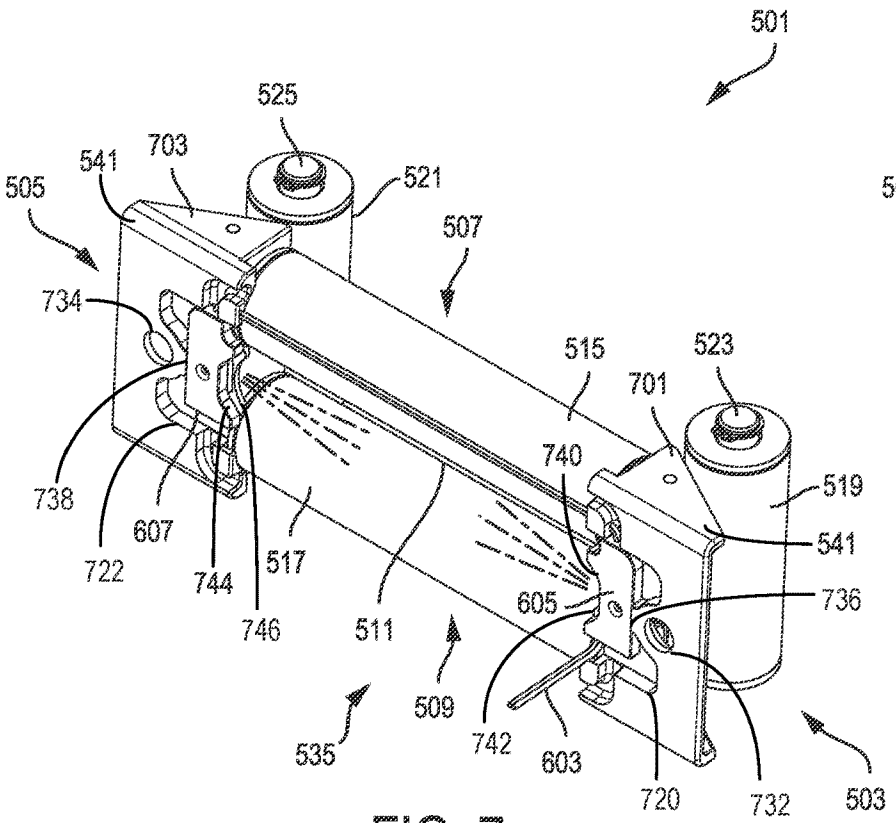
FIG. 7 shows a rear perspective view of the roller fairlead of FIG. 6 with the illumination module coupled to the fairlead.

The following description relates to systems and methods for fairleads. A fairlead, such as the fairleads shown by FIGS. 1, 5, and 9, may be coupled to a winch, such as the winch shown schematically by FIGS. 1, 5, and 9, in order to guide a rope of the winch. The fairlead includes a main opening configured to receive the rope. The main opening is formed through a body of the fairlead, as shown by FIGS. 1-4, and may be positioned between opposing rollers coupled to the body, as shown by FIGS. 5-11. The fairlead includes an illumination module configured to illuminate the main opening, drum, and winch. The illumination module may be seated within a recess at a rear end of the body and may illuminate the main opening, drum, and winch at opposing first and second sides of the fairlead, as shown by FIGS. 3 and 6-7. The fairlead may include another illumination module seated within another recess at the rear end of the body and configured to illuminate the main opening, drum, and winch at a top end of the fairlead, as shown by FIGS. 4 and 10. By including one or more illumination modules coupled to the body of the fairlead, the main opening, drum, and winch may be illuminated in order to increase a visibility of the rope and/or an ease of use of the fairlead.

Figure 1:
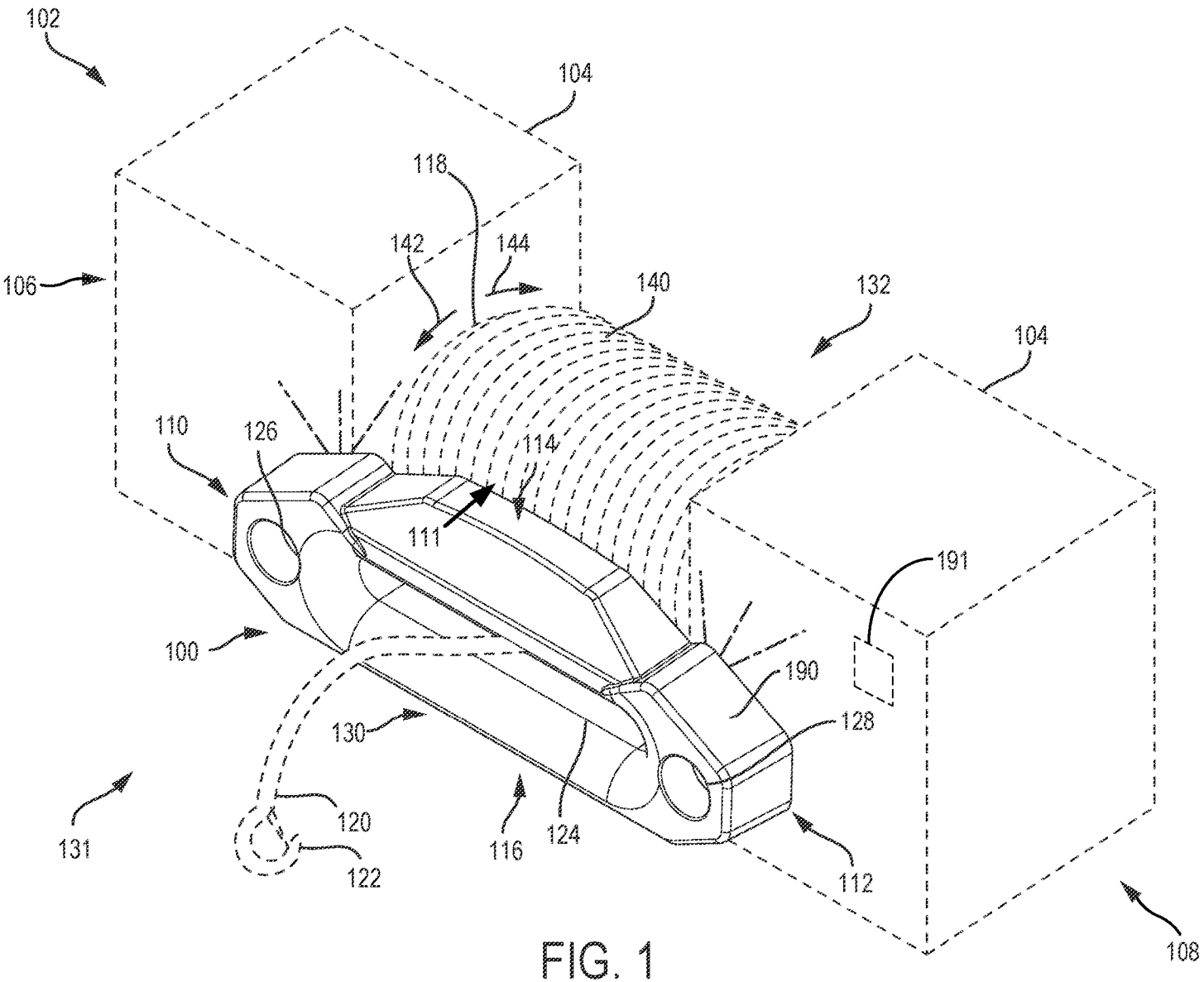
FIG. 1 schematically shows a winch including a fairlead having an illumination module.

Referring now to FIG. 1, a winch 102 is shown schematically, with fairlead 100 coupled to the winch 102 at a front end 111 (which may be referred to herein as an output end of the winch 102 and/or drum 118) of the winch 102. The winch includes a body 104 which may house one or more components of the winch 102, such as a motor, clutch, battery, electronic controller, etc. Drum 118 (which may be referred to herein as a rope drum) of the winch 102 is positioned centrally with respect to body 104. Drum 118 is coupled to the body 104 and is rotatable relative to the body 104 in a forward direction 142 and a reverse direction 144. In some examples, the winch 102 may include a control panel including a user interface (e.g., one or more buttons, switches, etc.) for control of the drum 118. For example, a user may interact with the user interface (e.g., push one or more of the buttons, switches, etc.) in order to drive (e.g., rotate) the drum 118 in the forward direction or reverse direction, or to stop a rotation of the drum 118. The control panel may be positioned at the body 104. In some examples, the winch 102 may additionally and/or alternately be controlled via a remote controller (e.g., via wireless electronic communication).

The winch 102 may include a rope 140 (e.g., a braided cable) wrapped (e.g., wound) around the drum 118. During operation of the winch 102, the drum 118 may be driven in the forward direction and/or reverse direction in order to control an amount of the rope 140 extending through main opening 124 of the fairlead 100 formed by body 190. The body 190 may be formed as a single, unitary piece (e.g., molded or otherwise formed together with the recesses, main opening 124, channels, surfaces, etc. described herein as a single unit)

Figure 2:
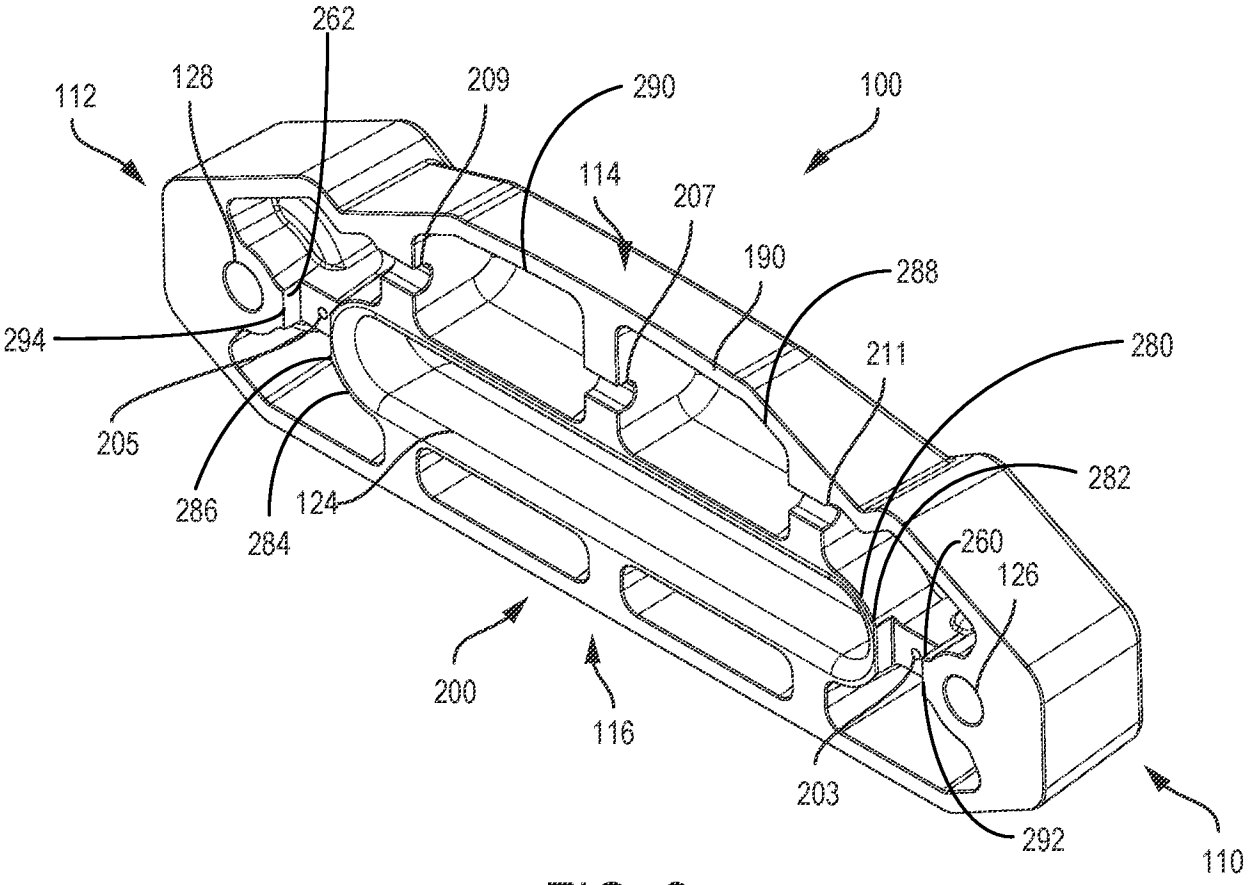
FIG. 2 shows a rear perspective view of the fairlead of FIG. 1 with the illumination module removed.

As shown by FIG. 1, a portion of the rope 140 is disposed within the main opening 124 of the fairlead 100, with an end 120 (which may be referred to herein as a free end) of the rope 140 positioned externally relative to the main opening 124 (e.g., external to the main opening 124 at a first end 130 of the fairlead 100 (which may be referred to herein as a front end), with the first end 130 opposite to a second end 200 (which may be referred to herein as a rear end), shown by FIG. 2, where the second end 200 is adjacent to the drum 118). Driving the drum 118 in the forward direction may unwrap a portion of the rope 140 from the drum 118 and increase the amount of the rope 140 positioned at the first end 130 of the fairlead 100, while driving the drum 118 in the reverse direction may reduce the amount of rope 140 positioned at the first end 130 and increase the amount of rope 140 wrapped around the drum 118. In other examples (e.g., examples in which the rope 140 is wound around the drum 118 in a reverse direction relative to the example shown by FIG. 1), the forward direction 142 and reverse direction 144 may be opposite to the directions shown by FIG. 1 (e.g., direction 144 may be the forward direction, and direction 142 may be the reverse direction). In the example shown by FIG. 1, the end 120 of the rope 140 is coupled to a hook 122 which may be attached to another object (e.g., a vehicle) in order to apply a pulling force to the object (e.g., by rotating the drum 118 in the reverse direction to increase a tension of the rope 140 and pull the hook 122 in the direction of the main opening 124 of the fairlead 100).

The main opening 124 of the fairlead 100 is positioned proximate to the drum 118 (e.g., main opening 124 is centered relative to the drum 118 and adjacent to the drum 118) and is shaped to guide the end 120 of the rope 140 through the fairlead 100 from the second end 200 to the first end 130. The main opening 124 may include one or more rounded or chamfered surfaces configured to more easily guide the rope 140 through the main opening 124 and reduce a likelihood of pinching of the rope 140. A first side 110 of the fairlead 100 may be coupled to the body 104 toward a first side 106 of the body 104, and an opposing, second side 112 of the fairlead 100 may be coupled to the body 104 toward an opposing, second side 108 of the body 104, with the main opening 124 centered between the first side 110 and second side 112 and positioned between a top end 114 and bottom end 116 of the fairlead 100. The fairlead 100 may include a first mounting feature 126 positioned at the first side 110 and a second mounting feature 128 positioned at the second side 112. In some examples, each of the first mounting feature 126 and second mounting feature 128 may be parallel passages extending through the fairlead 100 (e.g., through the body 190 of the fairlead 100) from the first end 130 to the second end 200, and each mounting feature may be configured to receive a respective fastener (e.g., bolt) to couple the fairlead 100 to the body 104 of the winch 102 at a first end 131 of the winch 102, opposite to a second end 132 of the winch 102. In this configuration, the fairlead 100 is positioned at the first end 131 of the winch 102, and the drum 118 is positioned between the first end 131 and second end 132 of the winch 102 adjacent to the second end 200 of the fairlead 100. First mounting feature 126 (which may be referred to herein as a first mount opening) is formed at least in part by first sidewall 292, and the second mounting feature 128 (which may be referred to herein as a second mount opening) is formed at least in part by second sidewall 294. Further, the first recess 280 is formed at least in part by the first sidewall 292 (e.g., first sidewall 292 forms a first inner surface 260 of the first recess 280), and the second recess 284 is formed at least in part by the second sidewall 294 (e.g., second sidewall 294 forms a second inner surface 262 of the second recess 284).

As described further below, the fairlead 100 includes illumination modules configured to illuminate the winch 102, drum 118, and main opening 124 from the second end 200. In some examples, the illumination modules may be electronically coupled to a power source (e.g., a battery) within the body 104 of the winch 102. In other examples, the fairlead 100 may include a power source separate from the power source of the winch 102 (e.g., a different battery, housed by the fairlead 100 and electronically isolated from the power source of the winch 102), and the illumination modules may electronically coupled to the power source of the fairlead 100. Further, in some examples, the illumination modules may be electronically coupled to one or more other components of the winch 102, such as the electronic controller 191 and/or control panel of the winch 102 (indicated schematically in FIG. 1). As one example, the illumination modules may be configured to illuminate the drum 118 and winch 102 during conditions in which the drum 118 is driven in the forward and/or reverse direction. As another example, the illumination modules may be configured to illuminate the drum 118 during conditions in which the winch 102 is activated by a user (e.g., powered on coupling a control switch to the winch 102 and/or adjusting a power switch of the winch 102 from an OFF position to an ON position). Other control configurations of the illumination modules are possible.

Referring now to FIG. 2, a rear perspective view of the fairlead 100 is shown, with the fairlead 100 decoupled from the winch 102. FIG. 2 shows the fairlead 100 with the illumination modules removed. The fairlead 100 includes a plurality of recesses at the second end 200, such as first recess 280, second recess 284, third recess 288, and fourth recess 290. Configuring the fairlead 100 to include the recesses may reduce a weight of the fairlead 100, which may decrease an overall weight of the winch 102 during conditions in which the fairlead 100 is coupled to the winch 102. Further, the recesses are shaped such that the illumination modules may be seated therein, providing a compact arrangement and reducing a size of the fairlead 100 relative to configurations that include external illumination modules (e.g., illumination modules not seated within the recesses).

In the example shown by FIG. 2, the fairlead 100 includes a first mounting surface 203 positioned within first recess 280 at the first side 110 of the fairlead 100, and a second mounting surface 205 positioned within second recess 284 at the second side 112 of the fairlead 100. The first mounting surface 203 and second mounting surface 205 are positioned opposite to each other at opposing sides of the main opening 124. The first recess 280 and the second recess 284 are arranged opposite to each other across the main opening 124. The first mounting surface 203 and second mounting surface 205 may be flat, planar mounting surfaces that are parallel with each other. The first mounting surface 203 and second mounting surface 205 may each be referred to herein as planar mount surfaces. Each of the first mounting surface 203 and second mounting surface 205 may include one or more respective holes or bosses configured to receive a respective fastener (e.g., bolt) for coupling one of the illumination modules to the fairlead 100. The first mounting surface 203 and the second mounting surface 205 are each recessed in a direction away from the second end 200 and toward the front end 130 (e.g., offset away from the second end 200 into the respective recesses of the fairlead 100).

The body 190 of the fairlead 100 further includes a plurality of channels formed at the second end 200. The channels may be positioned toward the top end 114 of the fairlead 100 and extending parallel with the main opening 124. In the example shown by FIG. 2, the fairlead 100 includes a first channel 211 positioned at the top end 114 toward first side 110, a second channel 207 positioned at the top end 114 and centered relative to the main opening 124, and a third channel 209 positioned at the top end 114 toward the second side 112. During conditions in which the illumination modules are coupled to the fairlead 100, one or more electrical connectors (e.g., wires) coupled to the illumination modules (e.g., electrical connectors of the illumination modules) may be seated within one or more of the first channel 211, second channel 207, and third channel 209. In some examples, as described further below, a portion of one or more of the illumination modules may be seated directly within one or more of the first channel 211, second channel 207, and third channel 209. The channels may join two or more of the recesses together. For example, second channel 207 is shown joining the third recess 288 and the fourth recess 290, first channel 211 is shown joining the third recess 288 and the first recess 280, and third channel 209 is shown joining the fourth recess 290 and the second recess 284.

Referring to FIG. 3, the fairlead 100 is shown in a configuration in which a first illumination module 301 is seated within the first recess and mounted (e.g., fastened, coupled, etc.) to the first mounting surface 203 (shown by FIG. 2), and a second illumination module 303 is seated within the second recess and mounted to the second mounting surface 205 (shown by FIG. 2). The first illumination module 301 may be seated entirely within the first recess 280 and the second illumination module 303 may be seated entirely within the second recess 284, with each of the first illumination module 301 and the second illumination module 303 arranged at the second end 200. In this configuration, no portion of the first illumination module 301 and second illumination module 303 may be arranged at the first end 130. The first illumination module 301 includes a flat, planar surface 270 configured to seat directly against the first mounting surface 203, and the second illumination module 303 includes a flat, planar surface 272 configured to seat directly against the second mounting surface 205. The planar surface 270 and planar surface 272 may be referred to herein as counterpart planar surfaces relative to the first mounting surface 203 and the second mounting surface 205, respectively. In some examples, each of the first illumination module 301 and second illumination module 303 may be a light-emitting diode (LED) module configured to emit light in one or more directions (e.g., the first illumination module 301 and second illumination module 303 may each include at least one light emitting diode configured to emit light toward the main opening 124 from the second end 200). For example, FIG. 3 illustrates light emitted by the first illumination module 301 in a first direction 311 and light emitted by the second illumination module 303 in a second direction 313 as dash-dot lines extending into the main opening 124 at the second end 200, where the second direction 313 is opposite to the first direction 311. Although each illumination module is illustrated with three dash-dot light emission lines, it should be understood that the light emitted by each illumination module may extend in other directions to fully illuminate the main opening 124. The illumination modules may emit light in other directions, such as directions away from the first end 130 of the fairlead 100, in order to provide illumination to other components (e.g., the illumination modules may additionally emit light in a direction of drum 118 and/or winch 102, as shown by FIG. 1, during conditions in which the fairlead 100 is coupled to the winch 102). The light emitted by the first illumination module 301 and second illumination module 303 may be a same, first color (e.g., a first wavelength corresponding to white light, yellow light, etc.), or the first illumination module 301 may emit light of the first color and the second illumination module 303 may emit light of a different, second color (e.g., a second wavelength corresponding to blue light, green light, etc.).

In some examples, the color (e.g., wavelength) and/or intensity of the light emitted by the illumination modules may be based on operating conditions of a winch to which the fairlead 100 is coupled (e.g., winch 102 shown by FIG. 1 and described above). For example, during conditions in which a drum of the winch (e.g., drum 118) is driven in the forward direction, the illumination modules may emit light of the first color (e.g., first wavelength), and during conditions in which the drum is driven in the reverse direction, the illumination modules may emit light of the second color (e.g., second wavelength). During conditions in which the drum is not driven, the illumination modules may be selectively turned on or off by the user or automatically turned on or off by the electronic controller of the winch. Other examples are possible.

The first illumination module 301 and second illumination module 303 may be electronically coupled to each other via electrical connector 202. Electrical connector 202 may be a wire or other electrically conductive connection. Electrical connector 202 is shown seated within each of the first channel 211, second channel 207, and third channel 209. In this configuration, the electrical connector 202 is seated away from an exterior of the fairlead 100, which may reduce a likelihood of contact of the electrical connector 202 with other surfaces of the fairlead 100 and components of the winch (e.g., during conditions in which the fairlead 100 is coupled to the winch).

The first illumination module 301 includes a first side surface 250 shaped to seat against the first inner surface 260 of the first recess 280, and the second illumination module 303 includes a second side surface 252 shaped to seat against the second inner surface 262 of the second recess 284. The first illumination module 301 additionally includes a side surface 264 shaped to curve around a first edge 282 of the main opening 124, and the second illumination module 303 includes a side surface 266 shaped to curve around a second edge 286 of the main opening 124, where the first edge 282 is arranged at the first side 110 of the main opening 124 and the second edge 286 is arranged at the second side 112 of the main opening 124. In this configuration, the side surface 264 and the side surface 266 may be mirror symmetric to each other, with a curvature of the side surface 264 being the same as a curvature of the first edge 282, and with a curvature of the side surface 266 being the same as a curvature of the second edge 286. The side surface 264 and side surface 266 may be referred to herein as edges.

Referring to FIG. 4, the fairlead 100 is shown in a configuration in which the first illumination module 301 and second illumination module 303 described above are removed, and a third illumination module 401 is seated within the plurality of recesses at the top end 114 of the fairlead 100. Similar to the examples described above, the third illumination module 401 may be an LED module configured to emit one or more colors of light (with light emission illustrated via dash-dot lines in FIG. 4). The third illumination module 401 includes a first section 403 seated within a first top recess and a second section 405 seated within a second top recess, with a third section 407 seated within the second channel 207 and joining the first section 403 to the second section 405. In this configuration, the third illumination module 401 is seated within both of the third recess 288 and the fourth recess 290. The third illumination module 401 may emit light in a direction from the top end 114 toward the bottom end 116 and into (e.g., across) the main opening 124. Specifically, the third illumination module 401 may illuminate the main opening 124, drum 118, and winch 102 from the top end 114, whereas the first illumination module 301 and second illumination module 303 may illuminate the main opening 124, drum 118, and winch 102 from the first side 110 and second side 112, respectively. By joining the first section 403 to the second section 405 via the third section 407 seated within the second channel 207, a length of the electrical connector 202 may be decreased, and the seated position of the third illumination module 401 may be further maintained. In some examples, each of the first section 403 and second section 405 may be coupled (e.g., fastened) to respective bosses or extensions joined to, or formed by, surfaces of the top recesses in order to further maintain the third illumination module 401 in the seated position. In other examples, the third illumination module 401 may be maintained in the seated position by the third section 407 (e.g., via a press-fit, or friction fit, of the third section 407 within the second channel 207). Other examples are possible.

In some examples, the fairlead 100 may include each of the first illumination module 301, second illumination module 303, and third illumination module 401. In such examples, each of the illumination modules may be electronically coupled to each other via electrical connector 202. In this configuration, the illumination modules may illuminate the main opening 124, drum 118, and winch 102 from each of the first side 110, second side 112, and top end 114, which may increase a visibility of surfaces of the main opening 124 to a user of the fairlead 100.

Figure 5:
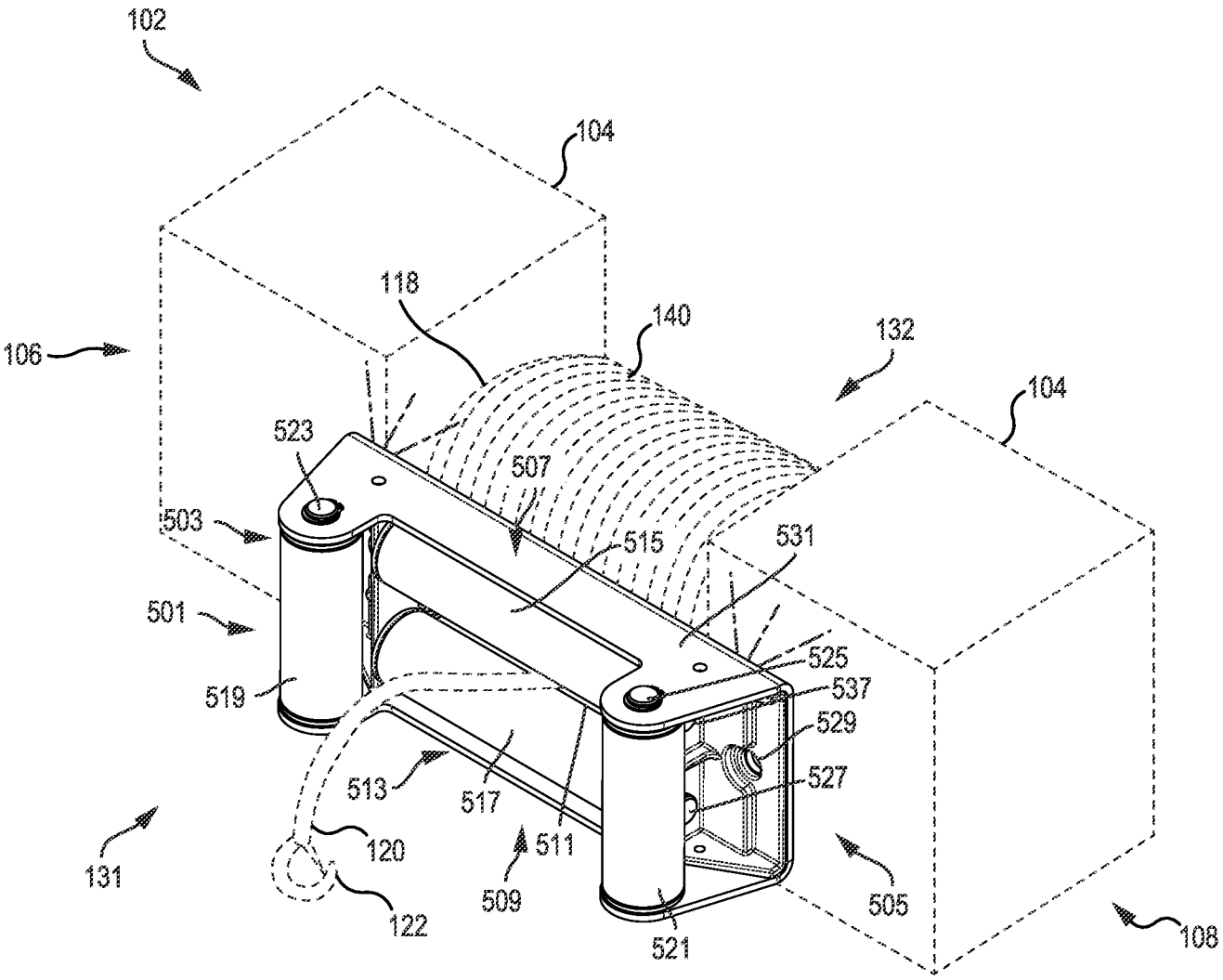
FIG. 5 schematically shows the winch including a roller fairlead having an illumination module.

Referring now to FIG. 5, winch 102 (described above with reference to FIG. 1) is schematically shown, with fairlead 501 shown in perspective. In the configuration shown by FIG. 5, fairlead 501 is coupled to the winch 102. Similar to the fairlead 100, fairlead 501 includes a main opening 511 configured to receive the rope 140 of the winch 102, with the end 120 of the rope 140 positioned externally relative to the main opening 511. The fairlead 501 may be referred to herein as a roller fairlead.

The main opening 511 of the fairlead 501 is positioned proximate to the drum 118 (e.g., main opening 511 is centered relative to the drum 118 and adjacent to the drum 118). A first side 503 of the fairlead 501 may be coupled to the body 104 toward first side 106 of the body 104, and an opposing, second side 505 of the fairlead 501 may be coupled to the body 104 toward opposing, second side 108 of the body 104, with the main opening 511 centered between the first side 503 and second side 505 and positioned between top end 507 and bottom end 509 of the fairlead 501. The fairlead 501 may include a first mounting feature 601 (shown by FIG. 6) positioned at the first side 503 and a second mounting feature 529 positioned at the second side 505. In some examples, each of the first mounting feature 601 and second mounting feature 529 may be passages extending through the fairlead 501 from a first end 513 (which may be referred to herein as a front end) to the second end 535 (which may be referred to herein as a rear end, shown by FIG. 6), and each mounting feature may be configured to receive a respective fastener (e.g., bolt) to couple the fairlead 501 to the body 104 of the winch 102 at first end 131 of the winch 102, opposite to second end 132 of the winch 102. In this configuration, the fairlead 501 is positioned at the first end 131 of the winch 102, and the drum 118 is positioned between the first end 131 and second end 132 of the winch 102 adjacent to the second end 535 of the fairlead 501.

Similar to the example described above, the fairlead 501 includes illumination modules configured to illuminate the drum 118 and winch 102, where the illumination modules may be electronically coupled to a power source of the winch 102, power source housed by the fairlead 501, and/or one or more components of the winch 102 (e.g., the electronic controller). Similar to the example described above, the illumination modules may be configured to illuminate the drum 118 and winch 102 during conditions in which the winch 102 is operated (e.g., the drum 118 is driven or the motor powering the drum is powered on) and/or responsive to activation of the winch 102 by a user (e.g., adjustment of the winch 102 from a powered-off mode to a powered-on mode via toggling of a power switch of the winch 102, or coupling a control switch to the winch 102). Other control configurations of the illumination modules are possible.

The main opening 511 of the fairlead 501 is formed between a plurality of rollers coupled to a body 531 of the fairlead 501. Specifically, in the example shown, the fairlead 501 includes a first roller 515 positioned toward top end 507 and rotatably coupled to the body 531 of the fairlead by a first pin 537, a second roller 517 positioned opposite to the first roller 515 at the bottom end 509 of the fairlead 501 and rotatably coupled to the body 531 by a second pin 527, a third roller 519 positioned toward the first side 503 and rotatably coupled to the body 531 by a third pin 523, and a fourth roller 521 positioned toward the second side 505 and rotatably coupled to the body 531 by a fourth pin 525. The first roller 515 and second roller 517 are arranged parallel to each other, while the third roller 519 and fourth roller 521 are arranged parallel to each other. The third roller 519 and fourth roller 521 are each arranged perpendicular relative to the first roller 515 and second roller 517. During conditions in which the rope 140 is disposed within the main opening 511, applying force to the rope 140 (e.g., increasing a tension of the rope 140) may cause the position of the rope 140 to shift within the main opening 511. The rope 140 may come into contact with one or more of the rollers, and as the rope 140 is pushed or pulled through the main opening 511, the corresponding rollers contacting the rope 140 may rotate as a result. Because the rollers may rotate responsive to a pushing or pulling of the rope 140 across the rollers, a likelihood of degradation of the rope 140 due to friction may be reduced.

Referring to FIG. 6, a rear perspective view of the fairlead 501 is shown. A first illumination module 605 is shown housed within an interior of the body 531 of the fairlead 501 toward the first side 503, and a second illumination module 607 is shown housed within the interior of the body 531 toward the second side 505. In some examples, the first illumination module 605 and/or the second illumination module 607 may be the same as the first illumination module 301 and second illumination module 303, respectively, described above with reference to FIG. 3. Each of the first illumination module 605 and second illumination module 607 may be an LED module configured to emit light into the main opening 511 of the fairlead 501 as indicated by dash-dot lines, and in some examples, the illumination modules may additionally emit light in other directions (e.g., toward the first end 513 and/or second end 535 of the fairlead 501, toward the winch 102 and drum 118 as shown by FIG. 5, etc.). Similar to the examples described above, the illumination modules may emit light of different colors, and/or the color and/or intensity of the light emitted by the illumination modules may be adjusted based on winch operation (e.g., adjusted based on whether the drum is driven in the forward direction, driven in the reverse direction, or not driven in the forward or reverse direction).

FIG. 7 shows fairlead 501 with a cover portion removed. The first illumination module 605 and second illumination module 607 may be electronically coupled to each other via electrical connector 603 within an interior of the body 531 of the fairlead 501, as shown by FIG. 7. The electrical connector 603 (e.g., electrically conductive wire) may extend between the first side 503 and the second side 505 at the top end 507. The first illumination module 605 may be seated within a first recess 720 of a body portion 701, with the body portion 701 arranged at the first side 503 of the body 541, and the second illumination module 607 may be seated within a second recess 722 of a body portion 703, with the body portion 703 arranged at the second side 505 of body 541. Each of the body portion 701 and body portion 703 may be joined to the body 531 by first pin 537 and second pin 527, in some examples. The fairlead 501 may be coupled to the winch 102 via fasteners inserted through first mount opening 732 and second mount opening 734, where the first mount opening 732 and second mount opening 734 may be parallel passages extending through the fairlead 501 (e.g., through the body 531 of the fairlead 501) from the first end 513 to the second end 535. The first mount opening 732 is partially formed by a first sidewall 736, and the second mount opening 734 is partially formed by a second sidewall 738. Similar to the examples described above, the first illumination module 605 includes a side surface 740 having a curvature shaped to match a curvature of an edge 742 of the first recess 720 forming a portion of the main opening 511, and the second illumination module 607 includes a side surface 744 having a curvature shaped to match a curvature of an edge 746 of the second recess 722 forming an opposing portion of the main opening 511.

Figure 8:
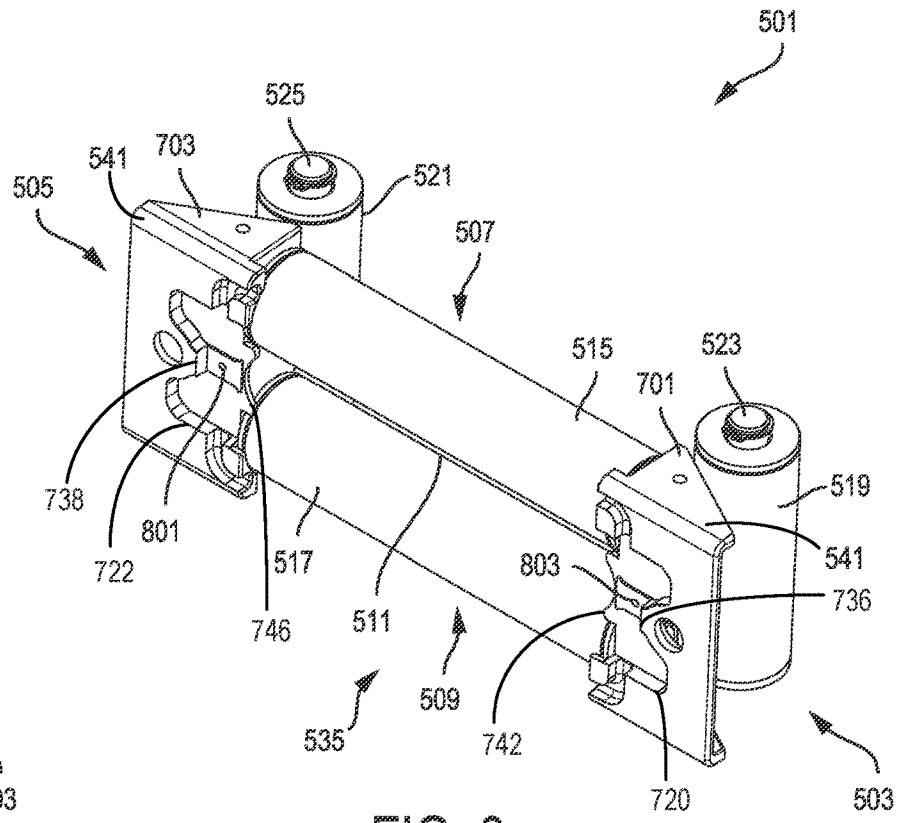
FIG. 8 shows a rear perspective view of the roller fairlead of FIGS. 6-7 with the illumination module removed.

FIG. 8 shows the fairlead 501 with the body 531, the first illumination module, and the second illumination module removed. The recess of the body portion 701 includes a mounting surface 803 configured to be in face-sharing contact with the first illumination module 605, and the recess of the body portion 703 includes a mounting surface 801 configured to be in face-sharing contact with the second illumination module 607. The mounting surface 801 and mounting surface 803 may be referred to herein as planar mount surfaces and may be parallel with each other. The first illumination module 605 may be mounted to the mounting surface 803 and the second illumination module 607 may be mounted to the mounting surface 801 via respective fasteners (e.g., bolts). In the example shown by FIGS. 5-8, the fairlead 501 (e.g., roller fairlead) includes the body 531 formed from multiple sections, such as body portion 701 and body portion 703. However, in some examples, the body 531 may be formed as a single, unitary piece (e.g., body portion 701 and body portion 703 may be molded together as a single unit).

Figure 9:
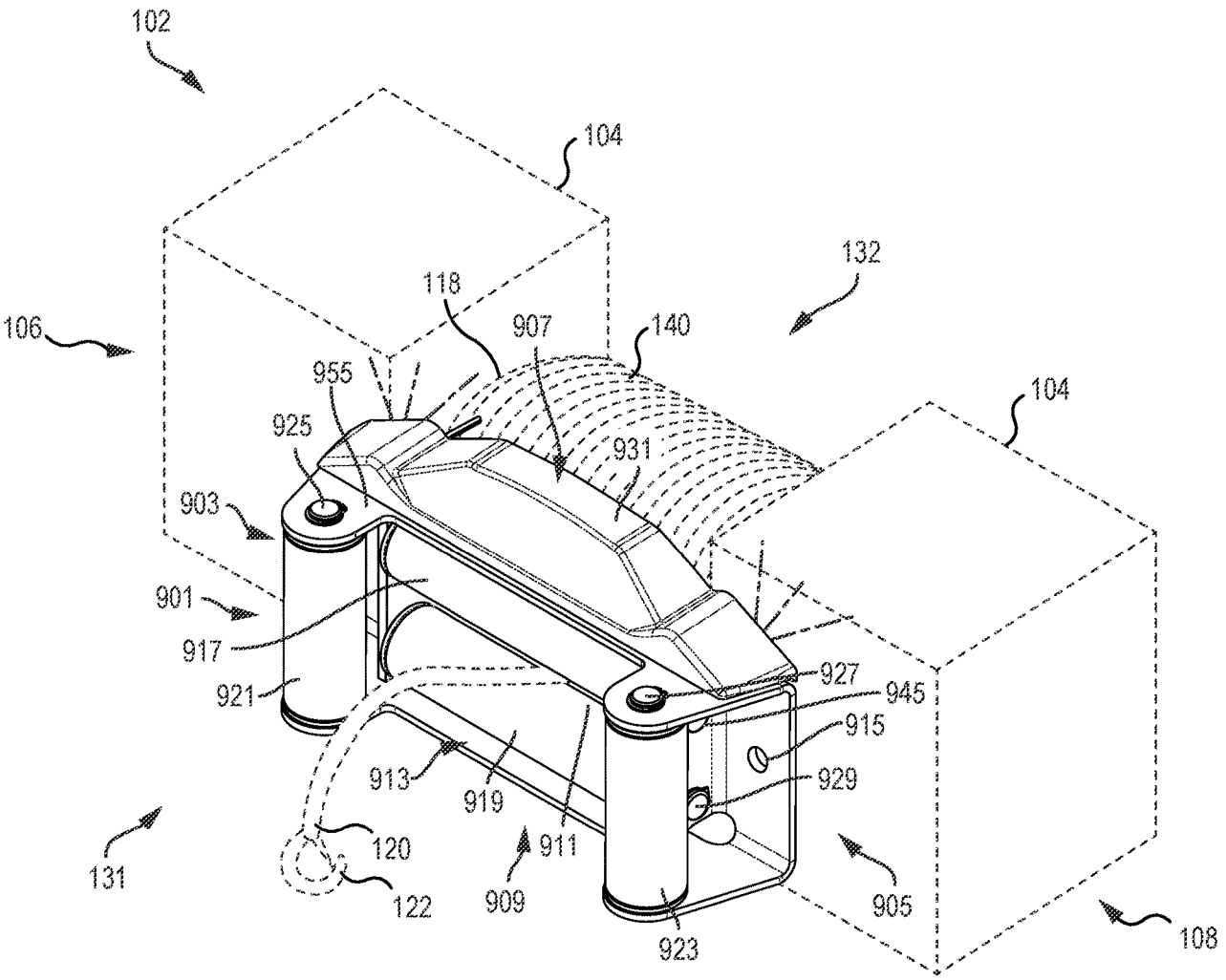
FIG. 9 schematically shows the winch including a hybrid roller fairlead having an illumination module.
Figure 10:
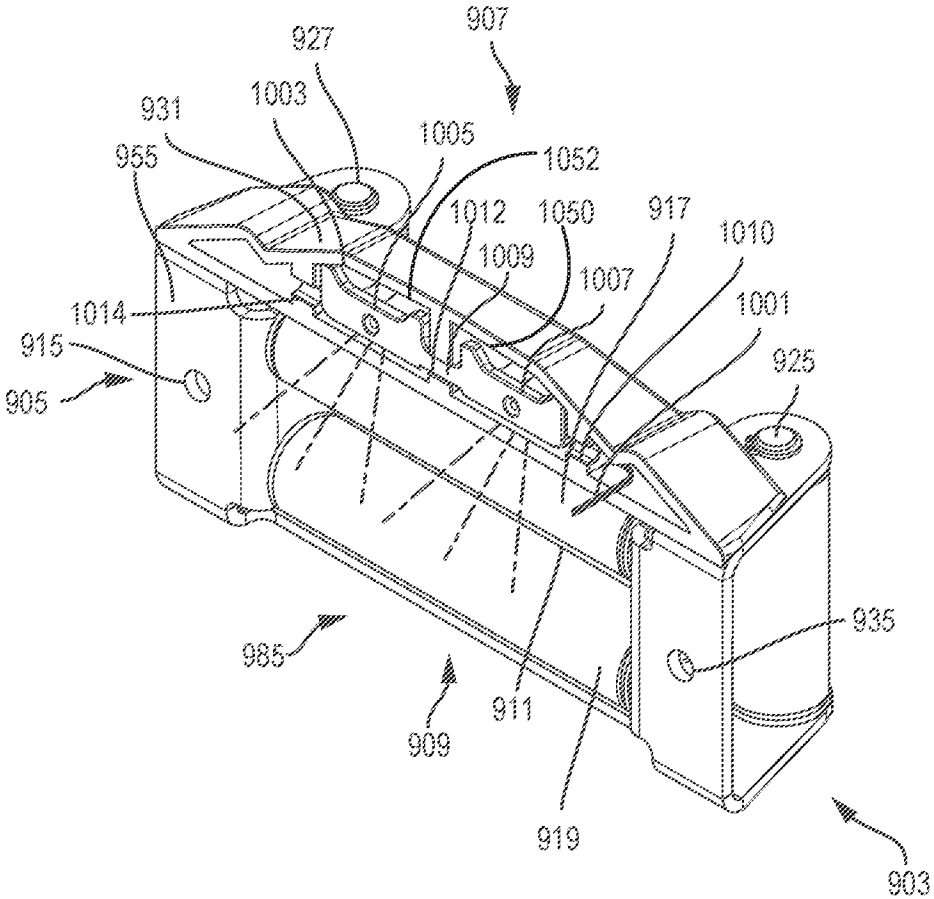
FIG. 10 shows a rear perspective view of the hybrid roller fairlead of FIG. 9 with the illumination module coupled to the fairlead.

Referring now to FIG. 9, winch 102 (described above with reference to FIG. 1) is schematically shown, with fairlead 901 shown in perspective. The fairlead 901 may be referred to herein as a hybrid roller fairlead. In the configuration shown by FIG. 9, fairlead 901 is coupled to the winch 102. Similar to the fairlead 501, fairlead 901 includes a main opening 911 formed between opposing rollers through a body 955 of the fairlead 901, with the main opening 911 configured to receive the rope 140 of the winch 102, with the end 120 of the rope 140 positioned externally relative to the main opening 911. The main opening 911 of the fairlead 901 is positioned proximate to the drum 118 (e.g., main opening 911 is centered relative to the drum 118 and adjacent to the drum 118). Similar to fairlead 501, a first side 903 of the fairlead 901 may be coupled to the body 104 toward first side 106 of the body 104, and an opposing, second side 905 of the fairlead 901 may be coupled to the body 104 toward opposing, second side 108 of the body 104, with the main opening 911 centered between the first side 903 and second side 905 and positioned between top end 907 and bottom end 909 of the fairlead 901. The fairlead 901 includes a first end 913 (which may be referred to herein as a front end) and an opposing, second end 985 (which may be referred to herein as a rear end), where the second end 985 is configured to face the winch 102 during conditions in which the fairlead 901 is coupled to the winch 102.

Fairlead 901 may include several features similar to fairlead 501 described above. For example, fairlead 901 may include a first mounting feature 935 (shown by FIG. 10), second mounting feature 915, first roller 917, second roller 919, third roller 921, fourth roller 923, first pin 945, second pin 929, third pin 925, and fourth pin 927, similar to first mounting feature 601, second mounting feature 529, first roller 515, second roller 517, third roller 519, fourth roller 521, first pin 537, second pin 527, third pin 523, and fourth pin 525, respectively, described above with reference to fairlead 501.

Further, fairlead 901 includes illumination modules configured to illuminate the main opening 911, drum 118, and winch 102, similar to the examples described above. The illumination modules included by fairlead 901 are seated within corresponding recesses of a housing 931 (which may be referred to herein as a housing portion) positioned at top end 907 of the fairlead 901. In some examples, housing 931 may be coupled to a top surface of the fairlead 901 at top end 907 via one or more fasteners (e.g., bolts). In other examples, housing 931 may be fused to the top surface of the fairlead 901 or formed together with the top surface (e.g., molded together with the top surface).

Figure 11:
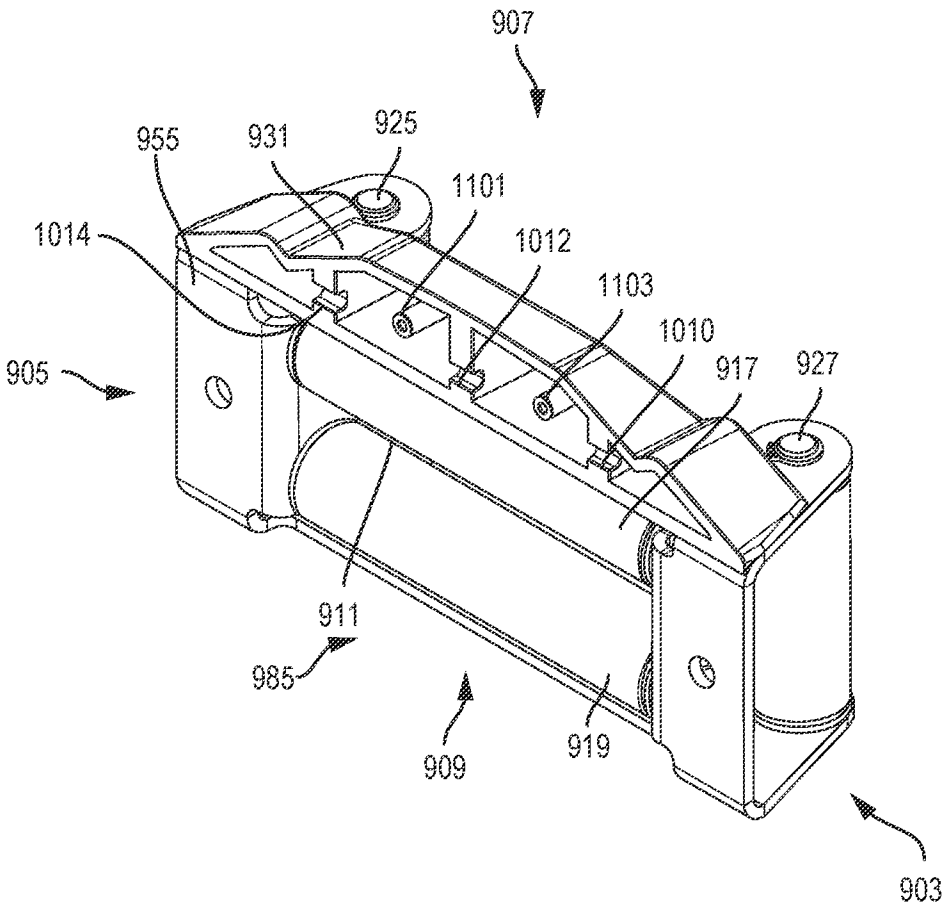
FIG. 11 shows a rear perspective view of the hybrid roller fairlead of FIG. 10 with the illumination module removed.

Referring collectively to FIGS. 10-11, different views of the fairlead 901 are shown, with the fairlead 901 decoupled from the winch 102. Specifically, FIG. 10 shows a rear perspective view of the fairlead 901, and FIG. 11 shows a rear perspective view of the fairlead 901 with the illumination modules removed.

Referring to FIGS. 10-11, illumination module 1003 is shown seated within recesses of the housing 931 at the top end 907. In particular, illumination module 1003 is seated within both of first recess 1050 and second recess 1052 formed by the housing 931 at the top end 907. The illumination module 1003 includes several portions similar to the third illumination module 401 shown by FIG. 4 and described above. For example, illumination module 1003 includes a first section 1005, a second section 1007, and a third section 1009, similar to the first section 403, second section 405, and third section 407 of third illumination module 401 described above. In some examples, the illumination module 1003 may be the same as the third illumination module 401 described above. Illumination module 1003 may be an LED module configured to emit light into the main opening 911 of the fairlead 901 from the top end 907, with light emission illustrated by dash-dot lines in FIGS. 9-10.

The housing 931 includes several features similar to those included by the fairlead 100 described above. For example, housing 931 includes a first channel 1010, a second channel 1012, and a third channel 1014 extending at the top end 907 between the first side 903 and second side 905, similar to the first channel 211, second channel 207, and third channel 209 of fairlead 100 described above. Electrical connector 1001 is electronically coupled to the illumination module 1003 and may be seated within one or more of the first channel 1010, second channel 1012, and third channel 1014, similar to the electrical connector 202 described above with reference to FIGS. 3-4. Further, the second section 1007 of the illumination module 1003 may be seated within the second channel 1012, similar to the second section 405 of third illumination module 401 seated within the second channel 207 of fairlead 100. In some examples, as shown by FIG. 11, the illumination module 1003 may be maintained in position within the housing 931 by coupling to one or more mounting surfaces of the housing 931, such as mounting surface 1101 and/or mounting surface 1103. Mounting surface 1101 and mounting surface 1103 are each formed as bosses within the recesses of the housing 931. In other examples, the illumination module 1003 may be maintained in position within the housing 931 via a press-fit or friction fit between the third section 1009 of the illumination module 1003 and the second channel 1012 of the housing 931.

In this way, by configuring the fairleads described herein to include the illumination modules, the main opening, drum, and winch may be illuminated in order to increase visibility of the rope and surrounding components. Further, by seating the illumination features within the recesses of the fairlead, the size and/or weight of the fairlead may be reduced while maintaining the visibility of the main opening. The arrangement of the illumination features within the recesses of the fairlead may provide increased illumination of the rope and drum, or spool, of the winch relative to examples which do not include illumination features arranged within the recesses.

FIGS. 2-4, 6-8, and 10-11 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In one embodiment, a fairlead comprises: a body including a front end, a rear end, and a main opening extending between the front end and the rear end, where the main opening is shaped to guide a free end of a rope from the rear end to the front end; a first recess formed in the body at the rear end; and a first illumination module seated within the first recess and configured to illuminate the main opening from the rear end. In a first example of the fairlead, the body includes a plurality of channels formed at the rear end and the first illumination module includes an electrical connector, with the electrical connector seated within the plurality of channels. A second example of the fairlead optionally includes the first example, and further includes wherein the body includes a second recess joined to the first recess by a first channel, with the first illumination module seated within each of the first recess, second recess, and first channel. A third example of the fairlead optionally includes one or both of the first and second examples, and further includes wherein the first recess includes a planar mount surface recessed in a direction away from the rear end and toward the front end, and the first illumination module includes a counterpart planar surface configured to seat directly against the planar mount surface. A fourth example of the fairlead optionally includes one or more or each of the first through third examples, and further includes wherein the illumination module includes at least one light emitting diode configured to emit light toward the main opening. A fifth example of the fairlead optionally includes one or more or each of the first through fourth examples, and further includes a second illumination module seated within a second recess of the body and configured to illuminate the main opening from the rear end. A sixth example of the fairlead optionally includes one or more or each of the first through fifth examples, and further includes wherein the second recess is arranged opposite to the first recess across the main opening, with the first illumination module configured to emit light into the main opening in a first direction and the second illumination module configured to emit light into the main opening in an opposing, second direction. A seventh example of the fairlead optionally includes one or more or each of the first through sixth examples, and further includes wherein the body includes a first mount opening extending through the body at a first side and a second mount opening extending through the body parallel with the first mount opening at an opposing, second side, where the first side is across the main opening relative to the second side, and a first sidewall of the first mount opening forms a first inner surface of the first recess and a second sidewall of the second mount opening forms a second inner surface of the second recess. An eighth example of the fairlead optionally includes one or more or each of the first through seventh examples, and further includes wherein the first illumination module includes a first side surface shaped to seat against the first inner surface of the first recess and a second side surface shaped to curve around an edge of the main opening. A ninth example of the fairlead optionally includes one or more or each of the first through eighth examples, and further includes wherein an entirety of the illumination module is arranged at the rear end, and no portion of the illumination module is arranged at the front end. A tenth example of the fairlead optionally includes one or more or each of the first through ninth examples, and further includes wherein the body is formed as a single, unitary piece including the main opening and the first recess. An eleventh example of the fairlead optionally includes one or more or each of the first through tenth examples, and further includes a plurality of rollers coupled to the body and surrounding the main opening, and a housing portion arranged at a top end of the body, where the housing portion includes the first recess and the first illumination module seated within the first recess. A twelfth example of the fairlead optionally includes one or more or each of the first through eleventh examples, and further includes wherein the housing portion further includes a second recess, with the first illumination module seated within both of the first recess and second recess, and the illumination module is configured to emit light into the main opening in a direction from the top end toward an opposing, bottom end. A thirteenth example of the fairlead optionally includes one or more or each of the first through twelfth examples, and further includes wherein the body includes a second recess, with the first illumination module seated within both of the first recess and the second recess, and the illumination module is configured to emit light into the main opening in a direction from a top end of the body toward an opposing, bottom end of the body. A fourteenth example of the fairlead optionally includes one or more or each of the first through thirteenth examples, and further includes a plurality of rollers coupled to the body and surrounding the main opening, and a housing portion of the body arranged at the top end, where the housing portion includes the first recess, the second recess, and the first illumination module.

In one embodiment, a system comprises: a winch including a rope drum; and a fairlead coupled to the winch at an output end of the rope drum, including: a body having a main opening; a recess arranged at a rear end of the fairlead facing the rope drum; and an illumination module seated within the recess and configured to illuminate the main opening and the rope drum at the rear end. In a first example of the system, the system further comprises: a power source; and a controller with computer readable instructions stored on non-transitory memory that when executed, cause the controller to: energize the winch via the power source to drive a rotation of the rope drum; and energize the illumination module via the power source to illuminate the main opening. A second example of the system optionally includes the first example, and further includes wherein the controller further includes instructions stored on non-transitory memory that when executed, cause the controller to: control the illumination module to emit light at a first wavelength responsive to a forward rotation of the rope drum; and control the illumination module to emit light at a second wavelength responsive to a reverse rotation of the rope drum. A third example of the system optionally includes one or both of the first and second examples, and further includes wherein the body of the fairlead includes a channel arranged at the rear end, with an electrical connector coupling the illumination module to the power source seated within the channel. A fourth example of the system optionally includes one or more or each of the first through third examples, and further includes wherein the illumination module is seated entirely within the recess, with the illumination module arranged between a planar mount surface of the recess and winch.

In another embodiment, a fairlead comprises: a body including a main opening having a first edge with a first curvature arranged at a first side of the body and an opposing, second edge with a second curvature arranged at an opposing, second side of the body; a first recess formed at a rear end of the body at the first side; a second recess formed at the rear end of the body at the second side; a first illumination module seated within the first recess and including a third edge having the first curvature; and a second illumination module seated within the second recess and including a fourth edge having the second curvature. In a first example of the fairlead, the first illumination module is configured to emit light from the third edge into the main opening, the second illumination module is configured to emit light from the fourth edge into the main opening, and the third edge is mirror symmetric to the fourth edge.

It will be appreciated that the configurations and routines disclosed herein are exemplary in nature, and that these specific embodiments are not to be considered in a limiting sense, because numerous variations are possible. For example, the above technology can be applied to other winch types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The invention claimed is:

1. A fairlead, comprising:

a body including a front end, a rear end, and a main opening extending between the front end and the rear end, where the main opening is shaped to guide a rope from the front end to the rear end;

a first recess formed in the body at the rear end; and a first illumination module seated within the first recess and configured to illuminate the main opening from the rear end.

2. The fairlead of claim 1, wherein the body includes a plurality of channels formed at the rear end and the first illumination module includes an electrical connector, with the electrical connector seated within the plurality of channels.

3. The fairlead of claim 1, wherein the body includes a second recess joined to the first recess by a first channel, with the first illumination module seated within each of the first recess, the second recess, and the first channel.

4. The fairlead of claim 1, wherein the first recess includes a planar mount surface recessed in a direction away from the rear end and toward the front end, and the first illumination module includes a counterpart planar surface configured to seat directly against the planar mount surface.

5. The fairlead of claim 1, wherein the first illumination module includes at least one light emitting diode configured to emit light toward the main opening.

6. The fairlead of claim 1, further comprising a second illumination module seated within a second recess of the body and configured to illuminate the main opening from the rear end.

7. The fairlead of claim 6, wherein the second recess is arranged opposite to the first recess across the main opening, with the first illumination module configured to emit light into the main opening in a first direction and the second illumination module configured to emit light into the main opening in an opposing, second direction.

8. The fairlead of claim 6, wherein the body includes a first mount opening extending through the body at a first side and a second mount opening extending through the body parallel with the first mount opening at an opposing, second side, where the first side is across the main opening relative to the second side, and a first sidewall of the first mount opening forms a first inner surface of the first recess and a second sidewall of the second mount opening forms a second inner surface of the second recess.

9. The fairlead of claim 8, wherein the first illumination module includes a first side surface shaped to seat against the first inner surface of the first recess and a second side surface shaped to curve around an edge of the main opening.

10. The fairlead of claim 1, wherein an entirety of the first illumination module is arranged at the rear end, and no portion of the first illumination module is arranged at the front end.

11. The fairlead of claim 1, wherein the body is formed as a single, unitary piece including the main opening and the first recess.

12. The fairlead of claim 1, wherein the body includes a second recess, with the first illumination module seated within both of the first recess and the second recess, and the first illumination module is configured to emit light into the main opening in a direction from a top end of the body toward an opposing, bottom end of the body.

13. The fairlead of claim 12, further comprising a plurality of rollers coupled to the body and surrounding the main opening, and a housing portion of the body arranged at the top end, where the housing portion includes the first recess, the second recess, and the first illumination module.

14. A system, comprising:

a winch including a rope drum; and a fairlead coupled to the winch at an output end of the rope drum, including:

a body having a main opening;

a recess arranged at a rear end of the fairlead facing the rope drum; and an illumination module seated within the recess and configured to illuminate the main opening and the rope drum at the rear end.

15. The system of claim 14, further comprising:

a power source; and a controller with computer readable instructions stored on non-transitory memory that when executed, cause the controller to:

energize the winch via the power source to drive a rotation of the rope drum; and energize the illumination module via the power source to illuminate the main opening.

16. The system of claim 15, wherein the controller further includes instructions stored on non-transitory memory that when executed, cause the controller to:

control the illumination module to emit light at a first wavelength responsive to a forward rotation of the rope drum; and control the illumination module to emit light at a second wavelength responsive to a reverse rotation of the rope drum.

17. The system of claim 15, wherein the body of the fairlead includes a channel arranged at the rear end, with an electrical connector coupling the illumination module to the power source seated within the channel.

18. The system of claim 14, wherein the illumination module is seated entirely within the recess, with the illumination module arranged between a planar mount surface of the recess and the winch.

19. A fairlead, comprising:

a body including a main opening having a first edge with a first curvature arranged at a first side of the body and an opposing, second edge with a second curvature arranged at an opposing, second side of the body;

a first recess formed at a rear end of the body at the first side;

a second recess formed at the rear end of the body at the second side;

a first illumination module seated within the first recess and including a third edge having the first curvature; and a second illumination module seated within the second recess and including a fourth edge having the second curvature, wherein the first illumination module is configured to emit light from the third edge into the main opening, the second illumination module is configured to emit light from the fourth edge into the main opening, and the third edge is mirror symmetric to the fourth edge.

20. A winch comprising:

a drum;

a fairlead having a body including a front end, a rear end, and a main opening extending between the front end and the rear end, where the main opening is shaped to guide a rope from the front end to the rear end, a first recess formed in the body at the rear end, a first illumination module seated within the first recess and configured to illuminate the main opening from the rear end and configured to illuminate the drum; and a plurality of rollers coupled to the body and surrounding the main opening.

* * * * *